US005195825A

United States Patent [19]

Ringrose

[11] Patent Number: 5,195,825

[45] Date of Patent: Mar. 23, 1993

[54] DEVICE FOR MIXING AT LEAST ONE AQUEOUS FLUID SUBSTANCE

[75] Inventor: Anthony Ringrose, Chene-Bougeries, Switzerland

[73] Assignee: Gene-Trak Systems, Framingham, Mass.

[21] Appl. No.: 613,478

[22] PCT Filed: May 9, 1988

[86] PCT No.: PCT/EP88/00419

§ 371 Date: Oct. 26, 1990

§ 102(e) Date: Oct. 26, 1990

[87] PCT Pub. No.: WO89/10785

PCT Pub. Date: Nov. 16, 1989

[51] Int. Cl.[5] ..... B01F 11/00; B04B 5/02

[52] U.S. Cl. ..... 366/213; 366/110; 494/19; 494/84

[58] Field of Search ..... 192/105 C; 366/110, 366/111, 197, 200, 202, 203, 208, 209, 211, 213; 422/99; 494/4, 16, 19, 52, 84

[56] References Cited

U.S. PATENT DOCUMENTS

| | | | |
|---|---|---|---|
| 955,355 | 4/1910 | Preston | 494/84 |
| 1,795,135 | 3/1931 | Molly | 192/105 C |
| 2,668,506 | 2/1954 | Moffett | 366/203 |
| 3,061,280 | 10/1962 | Kraft | 366/110 |
| 3,159,384 | 12/1964 | Davis | 366/112 |
| 3,432,149 | 3/1969 | Stalberg | 366/202 |
| 4,004,883 | 1/1977 | Meyer et al. . | |
| 4,555,183 | 11/1985 | Thomas | 366/208 |
| 4,656,009 | 4/1987 | Benajam | 494/16 |
| 4,834,548 | 5/1989 | Tempel | 366/208 |
| 4,921,676 | 5/1990 | Otani | 366/111 |

FOREIGN PATENT DOCUMENTS

| | | | |
|---|---|---|---|
| 160272 | 3/1981 | Denmark | 366/208 |
| 2135391 | 1/1973 | Fed. Rep. of Germany . | |
| 2062481 | 5/1981 | United Kingdom . | |
| 2124102 | 2/1984 | United Kingdom . | |

*Primary Examiner*—Harvey H. Hornsby
*Assistant Examiner*—Terrence R. Till
*Attorney, Agent, or Firm*—Cushman, Darby & Cushman

[57] ABSTRACT

The aim of the present invention is to provide a solution to the problem of mixing in a vessel two or more substances of which at least one is a liquid phase. The vessel preferably comprises a container having an open upper end which may be advantageously surrounded by a rim, and a closed bottom end. The mixing device most preferably comprises a support plate adapted to receive the container and to allow engagement therewith by a rotating mixing cylinder. A single rotational movement e.g. from a drive motor acting through a drive cylinder, causes the rotating mixing cylinder to simultaneously engage the sample container and drive the bottom of the container in a circular motion around a vertical axis in order to generate a vortex in the substances to be mixed. Very effective, automated mixing of the substances is thereby effected.

3 Claims, 1 Drawing Sheet

DEVICE FOR MIXING AT LEAST ONE AQUEOUS FLUID SUBSTANCE

BACKGROUND OF THE INVENTION

1. Field of the Invention

The following invention relates to a device for mixing at least one aqueous fluid substance contained in a vessel having an open upper end and a closed bottom end, said device comprising a support plate adapted for receiving at least one vessel.

2. Description of the Prior Art

It is well known in the field of bio-medical analyses to use a rotating disc having a plurality of vertical holes for receiving sample tubes. The disc is surrounded by processing stations and transfers the same tubes sequentially in order to process the samples contained therein for analysis. Generally, a sample to be analyzed is brought into reaction with one or more appropriate reagents. For obtaining good and reproducible results, it is very important that the different substances put into reaction be first thoroughly mixed together. Such mixing operation is difficult to achieve in certain circumstances. Sample-to-sample carryover via any mixing device must also be avoided.

The volumes of samples used in bio-medical analyses become smaller as miniaturization of apparatuses progresses, i.e. of the order of microliters, so that the liquid surface tension becomes high with respect to the liquid weight. To ensure measurement accuracy and to avoid contamination risks, it is usually not possible to use an agitator which is brought into contact with the liquid. Ultrasonic mixing has already been proposed but is not necessarily adapted to each kind of biomedical analysis. Indeed, when used in immuno-assay techniques, for example, ultrasonic energy generates cavitation which may break the complexes formed between antigens and specific antibodies, thus introducing source of error.

GB-A-2,124,102 already discloses a shaker for vessels supported at intervals around the peripheral portion of a turntable attached to a vertical axis. The shaker is supported by a board fitted below the turntable and comprises a motor, a crank fitted to a vertical shaft of the motor and an eccentric member pivotally attached to the crank, An elevator is disposed below the board in order to engage the eccentric member with the bottom of the vessel and further, the eccentric member is rotatively driven by the motor. The drawback of such an apparatus is to necessitate two motors one for the shaker and another for lifting the board supporting the shaker, which are to be controlled from a central monitoring device.

SUMMARY OF THE INVENTION

The aim of the present invention is to provide a solution to the problem of mixing, in a vessel two or more substances of which at least one is a liquid phase. The vessel preferably comprises a container having an open upper end, advantageously surrounded by a rim and a closed bottom end. The mixing device most preferably comprises a support plate adapted to receive the container and to allow engagements therewith by a rotating cylinder.

A single rotational movement e.g. from a drive motor acting through a drive cylinder, causes the rotating cylinder to simultaneously engage the sample container and drive the bottom of the container in a circular motion around a vertical axis in order to generate a vortex in the substances to be mixed. Very effective automated mixing of the substances is thereby effected.

BRIEF DESCRIPTION OF THE DRAWING

Other advantages of the device will become evident from the following description and from the accompanying drawing.

DETAILED DESCRIPTION

Figure 2:
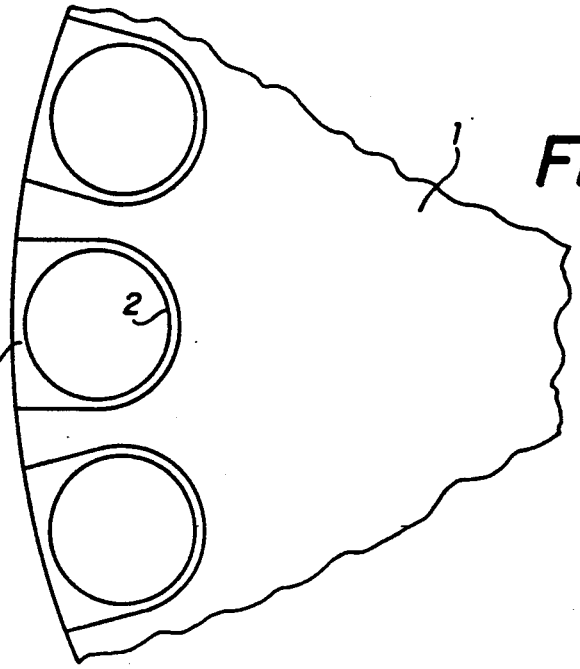
FIG. 2 shows a partial plan view of the turntable of the present invention.
Figure 1:
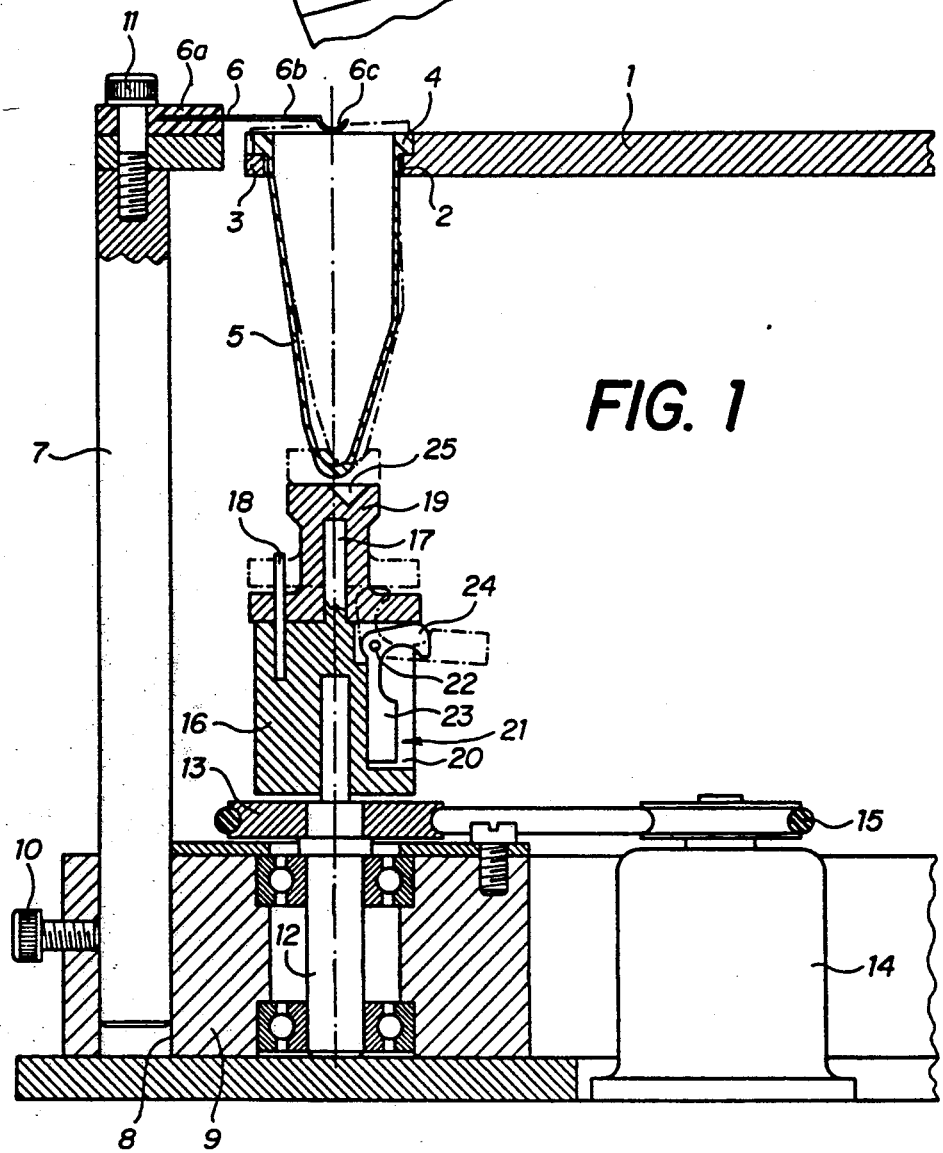
FIG. 1 shows a vertical sectional view of the preferred embodiment of the mixing device according to the present invention.

With reference to the figures, the device comprises a horizontal support plate 1 which represents, by way of an example, the turn table of an automatic analyser and which would normally be rotated around a vertical axis (not shown). This plate 1 contains at least one but most preferably a number of vertical axis recessed holes 2 a recess 3 which forms a support surface for a rim 4 extending, about the periphery of the open end of a sample tube 5 which is shown positioned in one of the recessed holes 2. The lateral wall of the tube 5 most preferably tapers downward toward its lower end and its closed bottom is rounded so that it forms preferably a hemispherical surface more conducive to mixing by the device of the instant invention. The tapered wall aspect is not however a pre-requisite to proper operation of the invention.

A leaf spring 6 is horizontally fixed at the upper end of a support rod 7 held in a bore 8 of a body 9 of the apparatus. A tightening screw 10 allows adjustment of the height of the leaf spring 6 with respect to the upper surface of the plate 1. This leaf spring 6 is held in a moulded part **6*a* which is fastened at the upper end of the support rod 7 by a screw 11. Preferably, this leaf spring 6 comprises two independent arms 6*b* the free ends of which incorporate a semi-cylindrical form 6*c*. The free ends rest against two diametrically opposed portions of the peripheral rim 4 surrounding the open upper end of the sample tube 5, so that this rim 4 is elastically pressed against the bottom of the recess 3**.

A rotating shaft 12 is mounted on bearings in the body 9 of the apparatus coaxially to the vertical positioning hole 2. This shaft 12 rigidly fixed to a driving-wheel 13 connected to a driving motor 14 by a belt 15. A drive cylinder 16 is rigidly connected to the upper end of the shaft 12, and includes a spindle 17 concentric to the shaft 12 and one or more pins 18 parallel to the spindle 17. A freely sliding mixing cylinder 19 is mounted on the spindle 17; pins 18 engage through holes of mixing cylinder 19 to prevent angular movement between it and drive cylinder 16.

Drive cylinder 16 is provided with three radial recesses 20 angularly equi-spaced around its central axis. In each recess 20, a lever 21 is freely suspended on a pin 22 which is perpendicular to the radial plane of the recess 20. This lever 21 has two arms, one of which 23 extends normally downwards, parallel to the cylinder axis, and the other one, 24, normally extends generally horizontal and adjacent to the lower face of mixing cylinder 19. The upper face of mixing cylinder 19 contains a conical recess 25 preferably cylindrical in shape or alternatively, conical in shape, eccentrically positioned with respect to the vertical axis of drive cylinder 16. The eccentricity between the conical recess 25 and the vertical axis of the cylinder 16 does not exceed the radius of the top surface of the conical recess 25.

When the motor 14 rotates the driving-wheel 13 sufficiently rapidly, the rotation of drive cylinder 16, on which the levers 21 are freely pivoted in their respective radial planes, generates a centrifugal force which is transmitted to these levers 21 so that the levers pivot to the position illustrated by dash-dot lines. In this position, the arm 24 of the levers pivot vertically upwards from drive cylinder 16 and lift mixing cylinder 19 up the spindle 17. As the central axis of the sample tube 5 is positioned inside of the circle formed by the conical recess 25 and as the bottom of this tube 5 forms a hemispherical surface, recess 25 engages with the hemispherical surface as the upwards displacement of the connection element 19 progresses. The bottom of the sample tube 5 is thus displaced sidewise and centered symmetrically with respect to the central axis of the conical recess 25; it therefore takes an offset position with regard to the central axis of the positioning hole 2 of the supporting plate 1. As illustrated, the tube 5 is also slightly raised against the retaining action of the leaf spring 6. Since the bottom of the tube 5 is offset from its normal position relative to the positioning hole 2, this bottom is in mesh with the connecting element 19 which is rotatively driven by cylinder 16 via pins 18. The upper end of this tube being positioned in the hole 2 and restricted from rotation by the rectangular recess, the tube 5 is subjected to a movement along an eccentric trajectory; this movement generates a vortex in the liquid of the tube 5 and the substances in this tube are subsequently mixed together.

When the driving of the shaft 12 is stopped, the levers 21 return by gravity to the position illustrated by the solid line, and the connecting element 19 drops downwards along the spindle 17 so that the sample tube 5 is disconnected from the mixing device.

Generally, as specified above the support plate is mounted on a vertical axis about which it rotates in a step-by-step motion. Thus, following disconnection of the sample tube 5 from the mixing device, the plate 1 may be rotated in order to position a new sample tube 5 coaxially with the rotating shaft 12 of the mixing device and the same mixing operation described above can then be repeated.

The vertical lifting of the connecting element 19 by the levers 21, the arms 24 of which are moved upwards by the centrifugal forces acting on the arms 23, depending upon rotation of the cylinder 16 is automatically carried out by the same driving means that is used for rotating the connecting element and thereby imparting a rotary movement to the sample tube around a conical trajectory. This element 19 is automatically disconnected by stopping the rotating shaft 12. Thus two functions are carried out by the same driving motor 14, i.e. the engagement of the connecting element 19 with tube bottom as well as the rotation of the bottom of this tube.

I claim:

1. Device for mixing at least one aqueous substance contained in a vessel having an open upper end and a closed bottom end, the device comprising:

a support plate for receiving at least one vessel, a resilient member cooperating with said support plate for retaining the vessel during mixing action, a mixing cylinder having a vertical axis and a recess eccentrically positioned with respect to said axis, said recess engaging the bottom end of the vessel upon upward movement of said mixing cylinder from a first position to a second position, and a drive cylinder member for imparting rotation to said mixing cylinder, said drive cylinder member including means for urging said mixing cylinder generally upward along said vertical axis from said first position to said second position simultaneously with said rotation, whereby said recess engages said vessel causing the bottom end of said vessel to be positioned eccentrically to said vertical axis and to rotate about said vertical axis, to thereby impart mixing action to the aqueous substance, said drive cylinder member being rotatable and said mixing cylinder being urged upward from said first position to said second position only when said drive cylinder member exceeds a predetermined rotational speed, said means for urging said mixing cylinder upwardly to said second position including at least one lever, pivotably mounted on said drive cylinder, said lever having an inoperative position at rotational speeds below the predetermined rotational speed of said drive cylinder member, and when said drive cylinder reaches a rotational speed greater than said predetermined speed, said lever moves to an operative position thereby urging said mixing cylinder upward to said second position.

2. The mixing device according to claim 1, wherein said vessel further comprises a rim about the periphery of the open upper end for engaging said support plate and said resilient member; said vessel further including tapering walls and a hemispherical bottom capable of being received by said recess of said mixing cylinder.

3. The mixing device of claim 2, wherein said support plate is adapted to receive a plurality of vessels and to rotate about a central axis whereby said vessels may be sequentially engaged with said mixing cylinder when said drive cylinder exceeds said predetermined rotational speed.

* * * * *